US008152747B2

(12) United States Patent
Khan et al.

(10) Patent No.: US 8,152,747 B2
(45) Date of Patent: Apr. 10, 2012

(54) SPINAL AND UPPER CERVICAL IMPULSE TREATMENT AND DEVICE

(76) Inventors: Aslam Khan, Vancouver (CA); Peter Wishart, Coquitlam (CA)

( * ) Notice: Subject to any disclaimer, the term of this patent is extended or adjusted under 35 U.S.C. 154(b) by 1022 days.

(21) Appl. No.: 10/599,295

(22) PCT Filed: Mar. 8, 2005

(86) PCT No.: PCT/CA2005/000353

§ 371 (c)(1),
(2), (4) Date: Apr. 23, 2008

(87) PCT Pub. No.: WO2005/092269

PCT Pub. Date: Oct. 6, 2005

(65) Prior Publication Data

US 2008/0312724 A1 Dec. 18, 2008

(51) Int. Cl.
*A61H 1/00* (2006.01)

(52) U.S. Cl. ..... 601/48; 601/46

(58) Field of Classification Search ..... 601/46, 601/48, 71; 607/17; 600/17, 481
See application file for complete search history.

(56) References Cited

U.S. PATENT DOCUMENTS

| | | | | |
|---|---|---|---|---|
| 3,880,170 | A * | 4/1975 | Popov | 607/71 |
| 4,243,025 | A | 1/1981 | Jones | |
| 4,461,286 | A | 7/1984 | Sweat | |
| 4,541,417 | A * | 9/1985 | Krikorian | 600/17 |
| 4,549,535 | A | 10/1985 | Wing | |
| 4,700,573 | A * | 10/1987 | Savord | 73/625 |
| 5,217,019 | A * | 6/1993 | Hughes | 600/481 |
| 5,618,315 | A | 4/1997 | Elliott | |
| 6,228,042 | B1 | 5/2001 | Dungan | |
| 6,585,668 | B2 | 7/2003 | Nissim | |
| 6,602,211 | B2 | 8/2003 | Tucek | |
| 2001/0014781 | A1 | 8/2001 | Nissim | |
| 2003/0230698 | A1 | 12/2003 | Strauss | |

FOREIGN PATENT DOCUMENTS

| | | | |
|---|---|---|---|
| CA | 2439667 | A1 | 3/2005 |
| EP | 0 101 081 | A1 | 8/1983 |

* cited by examiner

*Primary Examiner* — Michael A. Brown
(74) *Attorney, Agent, or Firm* — Gordon Thomson

(57) ABSTRACT

The current invention is a spinal and upper cervical impulse treatment device and controller, which delivers multiple impulses of variable frequency and variable force in a linear direction, as well as rotational forces, for patient treatment. Known chiropractic impulse devices are all hand held devices. In contrast, the spinal and upper cervical impulse treatment device is mounted on a fixed stand and armature, allowing reliable positioning and directional alignment in three dimensions. Fixed mounting also facilitates ease of use. A safety coupling is incorporated to avoid patient injury due to excessive force on the treatment site in the fixed mounting scenario Smooth sinusoidal waveforms are a preferred waveform for impulse delivery and sine waves are generated digitally in the apparatus. Data validation is used to ensure correct directional alignment prior to device activation Patient safety and consistency in treatment protocols are considered in the spinal and upper cervical impulse treatment design

18 Claims, 9 Drawing Sheets

SPINAL AND UPPER CERVICAL IMPULSE TREATMENT AND DEVICE

FIELD

The current invention comprises a spinal and upper cervical impulse treatment device designed from the overall perspective of minimizing potential harm to the patient and at the same time maximizing the efficacy of treatment to the patient, through the creation of predefined, accurate and repeatable operations. The general mode of treatment is delivery of linear and rotational impulses to a patient's body. These impulses are generated by a transducer component, which has been designed as an element of an integrated system.

BACKGROUND

U.S. Pat. No. 4,461,286 issued to Sweat describes a percussive device operated by a trigger. It is capable of delivering a single impulse via a thrust pin, where the force of the impulse is stored in a spring. The spring and thrust pin are housed in a hand held device. The handheld device is positioned manually by a practitioner, both in location and direction. The location of the point of contact on the patient's body and the direction of the thrust are both important elements of the spinal and upper cervical impulse treatment device.

While Sweat offers some degree of control and repeatability in the impulse delivered to the body, it has several drawbacks. The force of the impulse is dependent on the energy held in the spring, as defined by Young's modulus, and this will drift over time, in a mechanical device like a spring, U.S. Pat. No. 4,841,955 issued to Evans uses solenoids and suggests means to improve accuracy and repeatability in impulse forces. In both of these hand held devices (HHDs), the precise angle of the thrust is determined manually, and may not be accurate or repeatable. Lastly, both Sweat and Evans are able to deliver only a single impulse and do not provide feedback on directional alignment.

U.S. Pat. No. 4,549,535 issued to Wing describes the generation of multiple impulses through use of an electric motor in combination with solenoids. Pulse width, frequency and amplitude are controlled, but the use of the motor and solenoids suggests some imprecision. The general waveform f(t) described in Wing has a square wave shape, with an undefined duty cycle, that is, time of impulse versus duration of resting. The device is hand held and directional alignment is not addressed.

U.S. Pat. No. 5,618,315 issued to Elliott describes delivery of multiple impacts in a linear direction, as well as applying rotational forces. Delivery is performed by a separate handheld device (HHD), which provides visual feedback on direction alignment to the user. The HHD is managed by a separate controller device, including the user interface for input of impulse frequencies and modes, impulse energy, and HHD directional alignment angles.

The impulse waveforms disclosed in Elliott are specifically defined as square waves. This has more than one drawback. First, application of an abrupt force to sensitive parts of the body, like spinal vertebrae, is not desirable in spinal and upper cervical treatments. Further, a perfect square wave has infinite frequency components and is impossible to produce, in practice. Both electronic and mechanical systems which attempt to produce square waves will be driven to their performance limits, producing a waveform with overshoot on the rising and falling edges of pulses, followed by gradually decaying ringing, as seen in the bottom half of FIG. 4. Overshoot and ringing are high frequency artifacts, which/are viewed as undesirable in the intended application. If a square wave is filtered sufficiently to remove such artifacts and produce a smoother waveform, then it is no longer a square, wave by definition.

Both the abrupt nature of a square wave, and the high frequency artifacts described here, are seen as drawbacks in the application of an impulse device to spinal and upper cervical treatments.

Elliott has other drawbacks as well. The hand-held device (HHD) provides some visual feedback to a practitioner in terms of device positioning. The direction of the impulses to be delivered to the patient can be defined by two angles relative to vertical or by two direction vectors. These are input to the system on a separate, fixed controller unit, which may not be in the practitioner's direct field of vision during treatment. A set of light emitting diodes (LEDs) are placed in a cross-hair pattern on the top of the HHD, providing visual feedback to the user on the current angle of the device. Device positioning and directional alignment is done manually. A central LED lights up when a match to the preset direction vectors is achieved. At this time, the practitioner manually depresses a trigger to start impulse delivery.

The problems with this arrangement are subtle but significant. Even if the device is only moderately heavy, a practitioner may become mentally and physically fatigued after using it for several hours. The start of treatment depends on visual feedback and manual depression of a trigged. If the device moves out of alignment, there is no fail-safe mechanism. The visual feedback is a set of lights, not a set of direction vectors, which may or may not be preset correctly on a controller, and which are often outside the field of vision of the practitioner.

Some of these problems may be overcome by mounting the HHD on a fixed stand, an option mentioned by Elliott. Mounting the impulse device will reduce fatigue for the user and may also reduce the probability of misalignment during operation, but will not eliminate the potential for misalignment entirely. Elliott's impulse device has a rigid stylus and the stylus head is in contact with a sensitive part of the human body. Placement of the stylus head in a fixed location presents a new problem. Because the patient is also in a fixed location on a bed, a sudden movement by the patient can cause injury from contact with the stylus head. Therefore, the safety benefits gained from mounting the HHD on a fixed stand are counter-balanced by other safety problems introduced when creating a fixed location.

Elliott has some consideration for accuracy in its usage, but does not take a fail-safe approach, as just outlined. Efforts have not been made to eliminate all of the potential sources of human error during operation. In addition, the specification of a square wave as the impulse waveform is problematic, as explained above.

U.S. Pat. No. 6,228,042 issued to Dungan is similar to the device by Elliott, in that it enables the delivery of multiple impulses, at 30 Hz. Dungan's design continues to rely on components like solenoids or electric motors and is also a hand held device. Feedback on device alignment is not incorporated by Dungan, and for this reason the design is viewed as less effective than Elliott's.

U.S. Pat. No. 6,602,211 issued to Tucek also does not consider directional alignment. It uses a variable frequency controller and applies impulses through signals sent to electrical windings, which are analog in behavior and somewhat imprecise. Its primary feature is operational cut off when temperatures rise above an allowed setting. The latter feature is important for medical instruments used in the proximity of the body.

All devices discussed here have been hand held devices (HHDs), which generally lack precision in terms of the direction of delivery of impulses to the body for spinal and upper cervical treatment. Elliott is perhaps the best of these, since it offers some visual feedback on device direction. Operation is not fail-safe, however. Elliott also suggests mounting the device on a fixed stand, to reduce operator fatigue or directional inaccuracies, but a practical means of preventing patient injury from such a fixed device has not been considered.

Lastly, none of the devices described here have considered automation and data validation as an integral part of their design. Without comprehensive data validation, it is difficult to ensure safe, reliable and consistent instrument performance, as is highly desirable in spinal and upper cervical impulse treatments.

SUMMARY OF THE CURRENT INVENTION

The spinal and upper cervical impulse treatment device consists of a controller mounted on top of an impulse delivery mechanism, or device head, which is mounted, in turn, on a movable armature attached to a fixed stand. The device head may be rotated or tilted and located freely in three dimensions. At the base of the device head, there is a collapsible stylus or rod, which is used to deliver sinusoidal waveforms of varying frequency and intensity. The impulse waveforms can be delivered along both the linear axis of the stylus and in a rotational direction. Since the device head is fixed in location, a collapsible rod provides a necessary element of safety to the patient.

Importantly, the spinal and upper cervical impulse treatment device has built-in data validation, so that operation may not commence, until proper alignment of the device head is achieved. This is superior to a situation where correct alignment relies on human recognition of visual feedback mechanisms and operation may be triggered at any time. Accuracy is further improved by use of a digital controller and precision voice coil actuators, rather than components with variable output behavior, like solenoids. The linear force delivered is sinusoidal, and does not have the overshoot, bounce or harmonic characteristics of square waves, and, therefore, is a superior means of applying force for spinal and upper cervical adjustments.

Optionally, impulse control parameters may be transferred to the device in an automated fashion from a remote computer data source. Direction vectors are determined by a practitioner from examination of patient x-rays. Data may be input to the computer system by means of a graphics tablet, where the latter is used to digitize input data that is used to calculate direction vectors. Such automation further enhances the ease of use of the over-all system, as well as contributing to accuracy, consistency, and reliability in treatment protocols.

BRIEF DESCRIPTION OF THE DRAWINGS

Further features and advantages will be apparent from the following detailed description, given by way of example, of a preferred embodiment taken in conjunction with the accompanying drawings, wherein.

DETAILED DESCRIPTION OF PREFERRED EMBODIMENTS OF THE INVENTION

Device Mounting and Device Head Components

Figure 1:
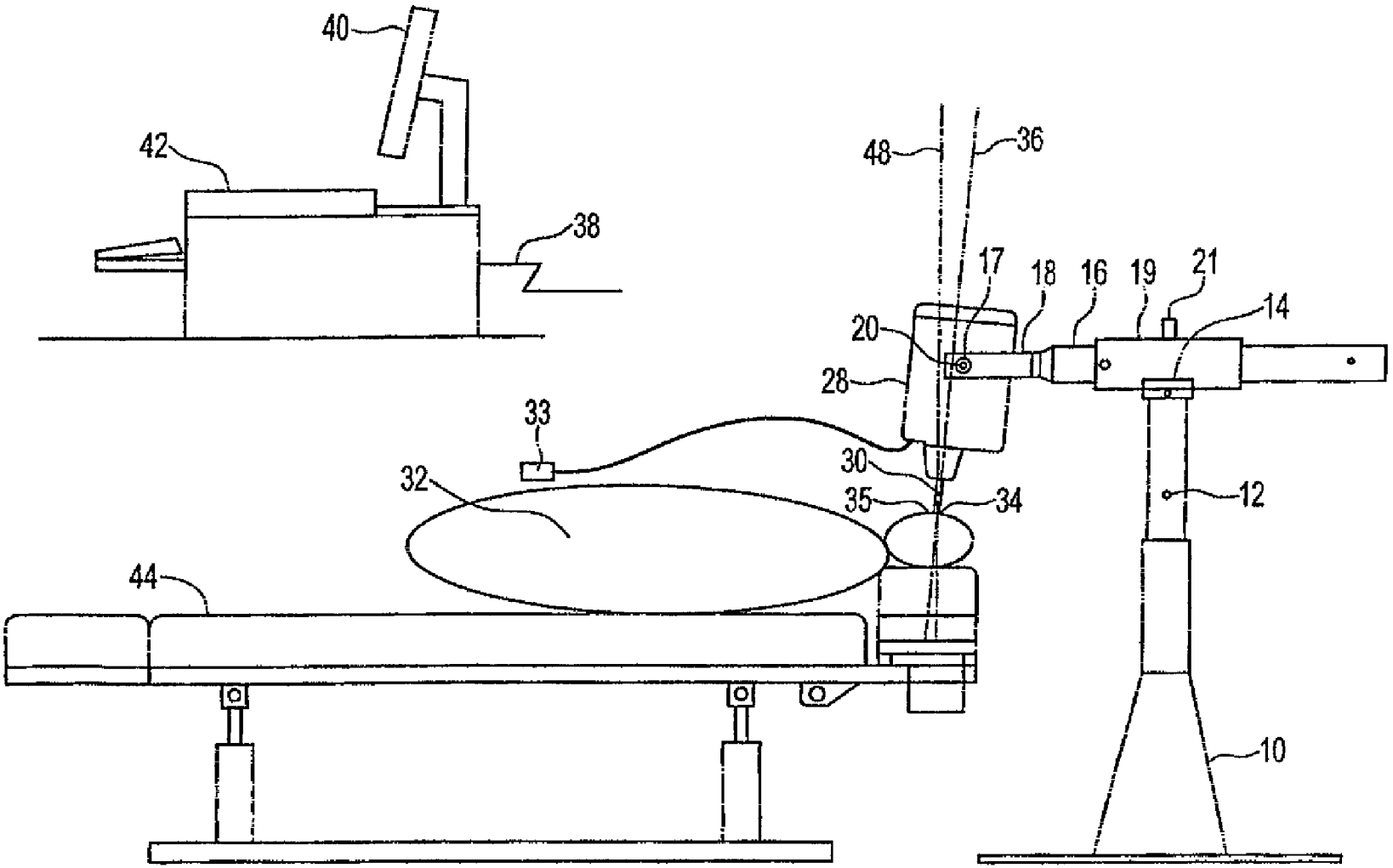
FIG. 1 is a side elevation view of the overall, stand, armature and device head, shown in relation to a patient being treated and a remote computer used to determine automated treatment parameters.

As shown in FIG. 1, a stable stand 30 supports an arm or armature component 16, which in turn supports the impulse treatment device head 28. Arm 16 is slidably enclosed by sleeve 19. The stand 10 can raise or lower the arm 16 by a large retractable piston or linear actuator 12 that is operator controlled. The arm 16 is mounted at the top of the stand's piston 12 at a complex joint with three degrees of freedom, called the stand coupling 14. The stand coupling 14 allows the arm 16 to rotate in a horizontal plane, creating a yaw angle. Where did this come from? The transducer head can tilt in this direction but the arm cannot. Last, the stand coupling 14 allows a tilt of the aim 16 off the horizontal plane, creating a roll angle. The aim 16 slides forward and back in sleeve 19 relative to the stand 10. Releasing a lock 21 allows arm 16 to rotate within sleeve 19. A groovein arm 16 and a biased ball bearing in the interior cylindrical surface of sleeve 19 pauses arm 16 to encounter the resistance of having to move the ball bearing out of the groove in arm 16 when rotating arm 16 relative to sleeve 19. A yolk 18 has two arm components, which curve around and attach to the device head 28 by means of dual pivot points 20 on either side of the device head 28. The yolk 18 is supported by arm 16. The yolk 18 is best seen in the top view of the apparatus in FIG. 1A. There is a manual locking mechanism 17 close to the pivot point 20 on one side of the device head 28. A touch screen 26 at the top of the device head 28 displays a user interface which is used for device positioning and control.

A collapsible stylus 30 protrudes from the device head 28 and its end point 34 is used to deliver impulses to a predetermined contact point 35 on a patient's body 32. The point of contact 35 may be the top or atlas vertebra, behind the ear, as shown in FIG. 1. The patient 32 is lying on a bed 44 and the desired contact point 35 is in a fixed location. The many components and degrees of freedom of the device head 28 mounting scheme described above in combination, allow positioning of the linear axis 36 of the device head 28 and collapsible stylus 30 in any direction in three dimensions (3D), while simultaneously keeping the end of the stylus end 34 at a desired fixed location in 3D. For treatment, this fixed location is the contact point 35 on the patient 32.

At the time of treatment, the linear axis of the stylus is in any selected angle 36 in 3D, and this angle is calculated relative to the vertical direction 8 in the preferred embodiment. Angular control is explained below.

Also shown on FIG. 1 is a remote computer 40, which may be in any location and is not necessarily close to the treatment area. Patient data from x-rays and overlaid drawings or other drawings are digitized and input to the remote computer 40 by means of a graphics tablet 42 peripheral. Calculations are made in the remote computer 40 on the raw data and operating parameters are derived. These parameters are sent to the spinal and upper cervical impulse treatment device by means of any data communications link 38, such as a serial data link or wireless link. The types of links are not limited.

Figure 2:
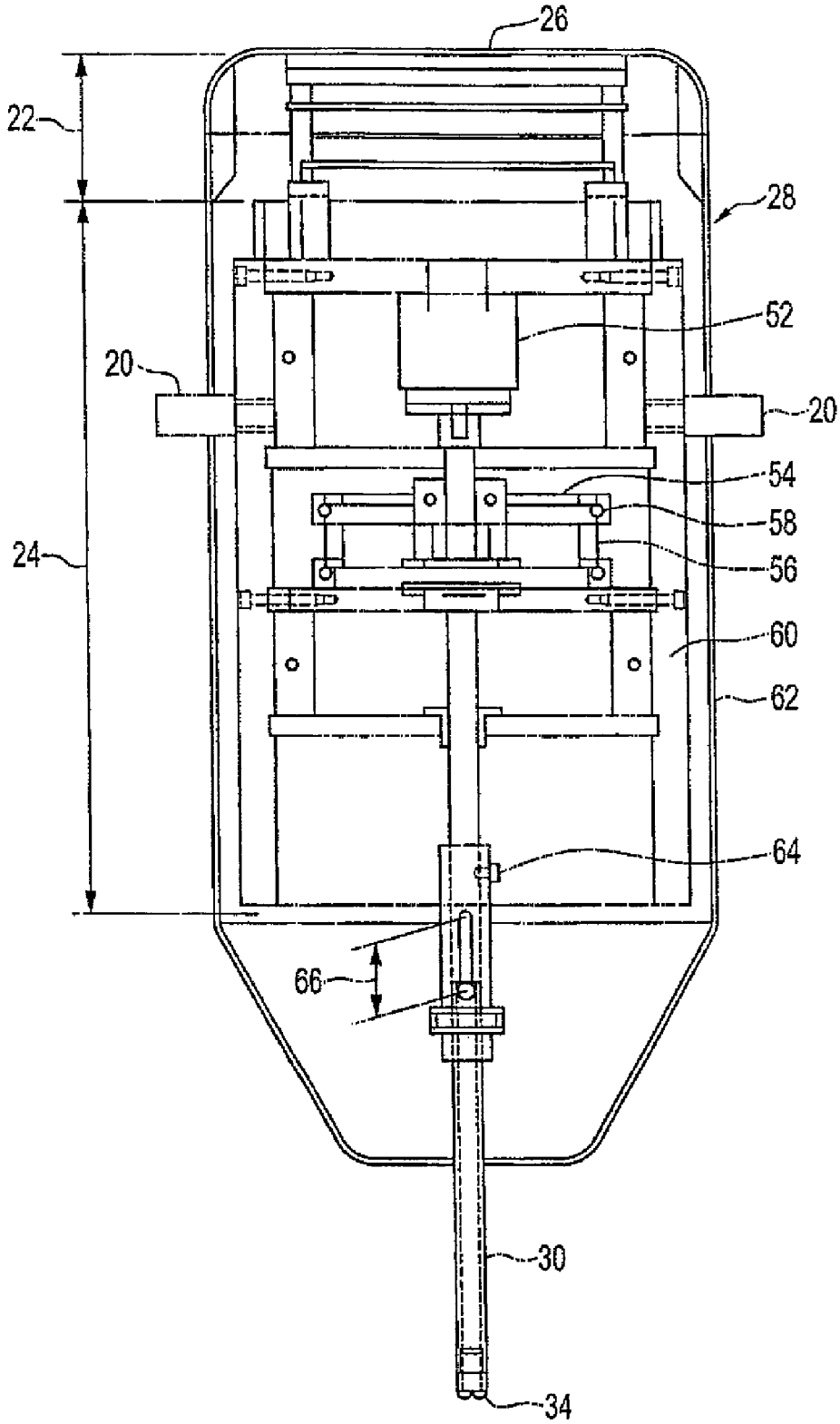
FIG. 2 is a front view of the device head, incorporating a controller with a local user interface, a transducer and stylus, where the latter applies impulses to a patient body.

With reference to FIG. 2, the device head 28 includes a shielded enclosure 62 or housing, designed to conform to EMI standards. A power supply has been removed from the view in FIG. 2. The main components of the device head 28 are a controller 22 section, a transducer 24 section, and the collapsible stylus 30 The controller section includes a touchscreen 26, which displays a user interface and an electronics motherboard 70 (see FIG. 3). The transducer 24 section includes a voice actuator, a stepper motor and other parts to connect them to the collapsible stylus 30. A linear voice coil actuator 52 is attached at the top of the collapsible stylus 30 axis and is used to deliver sinusoidal impulse waveforms along the collapsible stylus 30 linear axis. A large gear 54 holds the collapsible stylus 30 in position along its longitudinally extending axis. The large gear 54 is movable in the axial direction, allowing easy linear motion, but is rigid torsionally. A flexible belt 56 having a toothed surface on one side which engages the large gear 54 is driven by a rotational stepper motor which causes the flexible belt 56 to rotate through a precise angle to deliver a required amount of rotational motion to the collapsible stylus 30 during the time it contacts the patient. Sensors are employed in conjunction with the movement of the belt to limit the angle through which the probe can move. A constant torque is provided by the stepper motor. The voice coil actuator is a precision audio component and is readily commercially available.

Figure 3:
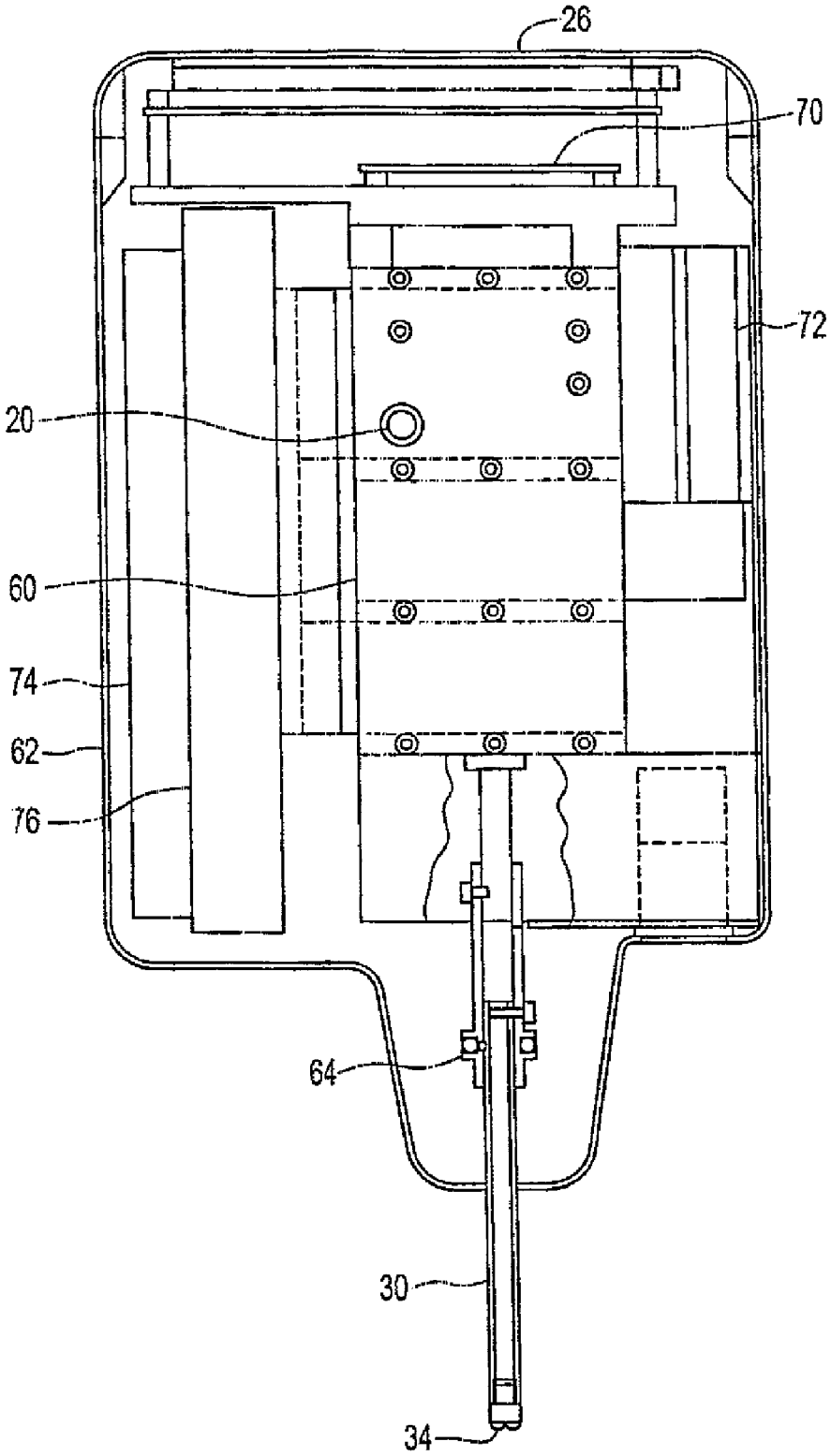
FIG. 3 is a side view of the device head.

FIG. 3 illustrates additional components of the device head, as needed for an electronic device. An optional cooling fan 72 is shown on the right and a large heat sink 76 and power supply 74 are shown on the left. The large heat sink 76 is connected to the transducer frame 60 to dissipate transducer heat and it is connected to the power supply 74, another heat source in the device. The heat sink is aluminum and relatively light for its size, but weight is not a major issue, since the device head is mounted on a fixed stand. The size of the heat sink enables excellent heat dissipation, which is a concern in a medical device. A controller 22, comprised of a touchscreen 26 and electronics motherboard 70, is shown at the top. Components may appear in alternate locations in different device embodiments, although a shielded housing 62 will always be on the outside. The collapsible stylus 30 will always have a linear axis with a measured direction and this will most often be placed approximately along the centerline of the transducer 24 component.

Safety Coupling

Figure 2A:
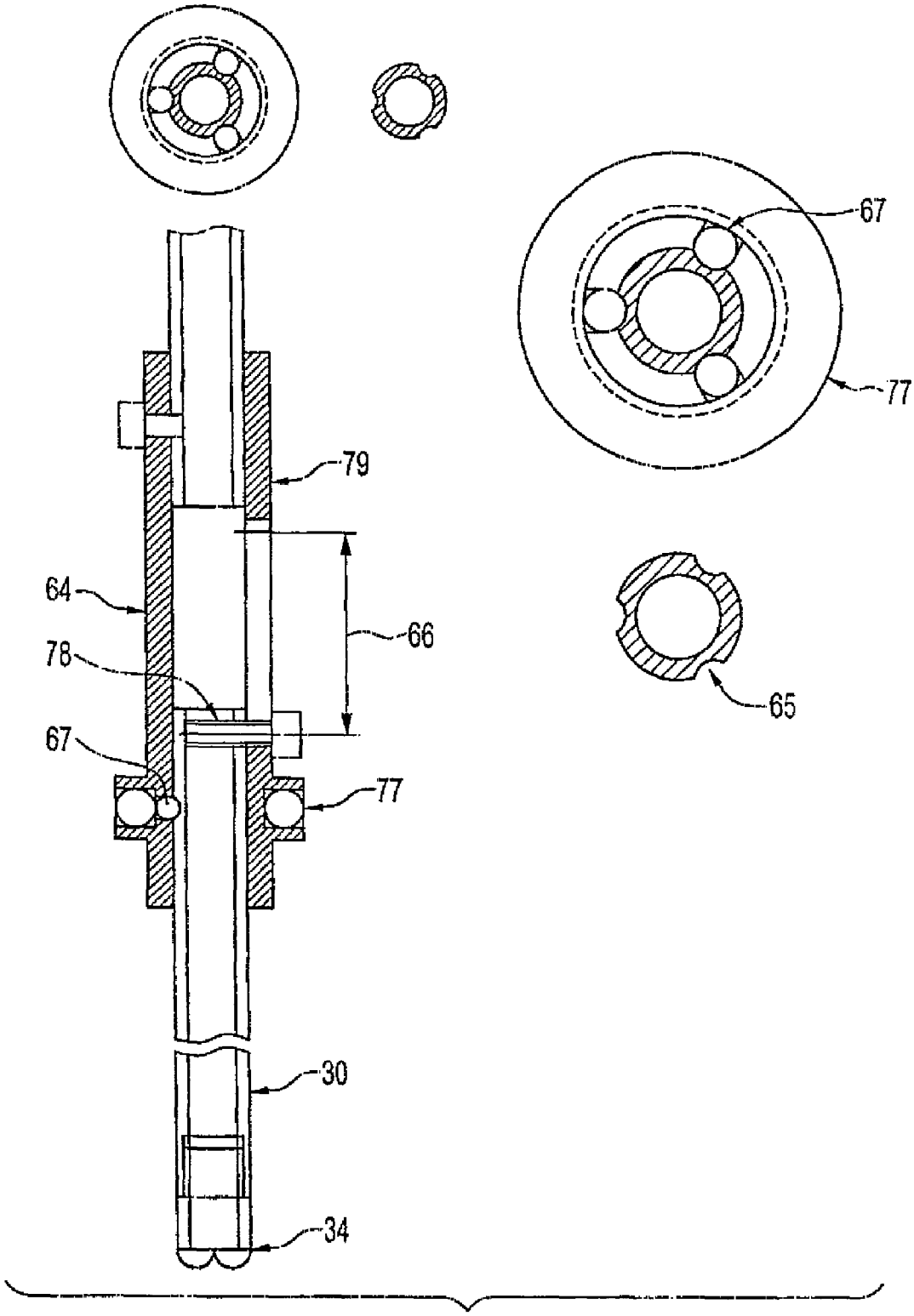
FIG. 2A is a side view of the safety coupling incorporated in the stylus in FIG. 2.

A safety coupling 64 is incorporated along the stylus 30 linear axis as shown in FIG. 2. The safety coupling 64 is an important component, for patient safety, since the patient contact point and stylus end 34 are both in fixed locations in space. The safety coupling allows the stylus to collapse by up to one inch under a moderate applied force in the linear axis, however, the force must exceed the normal treatment force. This safety coupling on the stylus is referred to as the 'collapsible stylus'. The safety coupling 64 is shown in more detail in FIG. 2A. The stylus is comprised of two separate parts, namely an outer sleeve 79, at the top of the safety coupling 64, and a lower stylus tube 30, which fits into the safety coupling sleeve 79. The range of motion 66 of the stylus tube 30 in the sleeve 79 is approximately one inch and is sufficient to avoid injury due to sudden movements by the patient. The range of motion 66 is controlled by a guide pin 78 and slot arrangement, which are also visible in FIG. 2. The degree of force needed to cause stylus 30 to collapse is controlled by an o-ring 77 which presses three steel, balls 67 against the walls of the stylus tube. The three steel balls 67 are at 120° angles to one another, as shown in the horizontal cross-section of the o-ring on the right side of FIG. 2A. During normal operation, the three steel balls 67 press into three spherical indents 65 along the stylus tube 30 wall creating a firm contact, so that the sleeve 79 and stylus tube 30 move in tandem. A sufficient force will allow the three steel balls 67 to expand the o-ring 77 so that the balls pop out of the indents 65. The stylus tube 30 then collapses upward into the safety coupling sleeve 79 which incorporates a Hall effect sensor which senses the collapsed position and turns the machine off. The stylus tube 30 is reset manually by pulling on the stylus end 34 until the balls clicks into place. As an additional safety feature, arm 12 cannot be lowered any further into stand 10 once the stylus tube 30 has been collapsed. In addition, the collapsing of the stylus tube 30 shuts off the machine.

Another safety feature is a deadman switch 33 that is operated by the patient to stop the machine in the event of any malfunction.

Transducer and Waveform Characteristics

Transducer 24 design within the spinal and upper cervical impulse treatment device is also aimed at greater accuracy and consistency of operation than available in known devices. Voice coil actuators 52 and 58 are used for both linear and rotational movements, enabling greater accuracy. These components are selected for stability over a range of operating temperatures and may be calibrated at the time of manufacture. Displacement sensors and precision clocks (crystal oscillators) may be used to monitor performance and make dynamic adjustments, as directed by the controller 22, to ensure that calibration is maintained.

Figure 4:
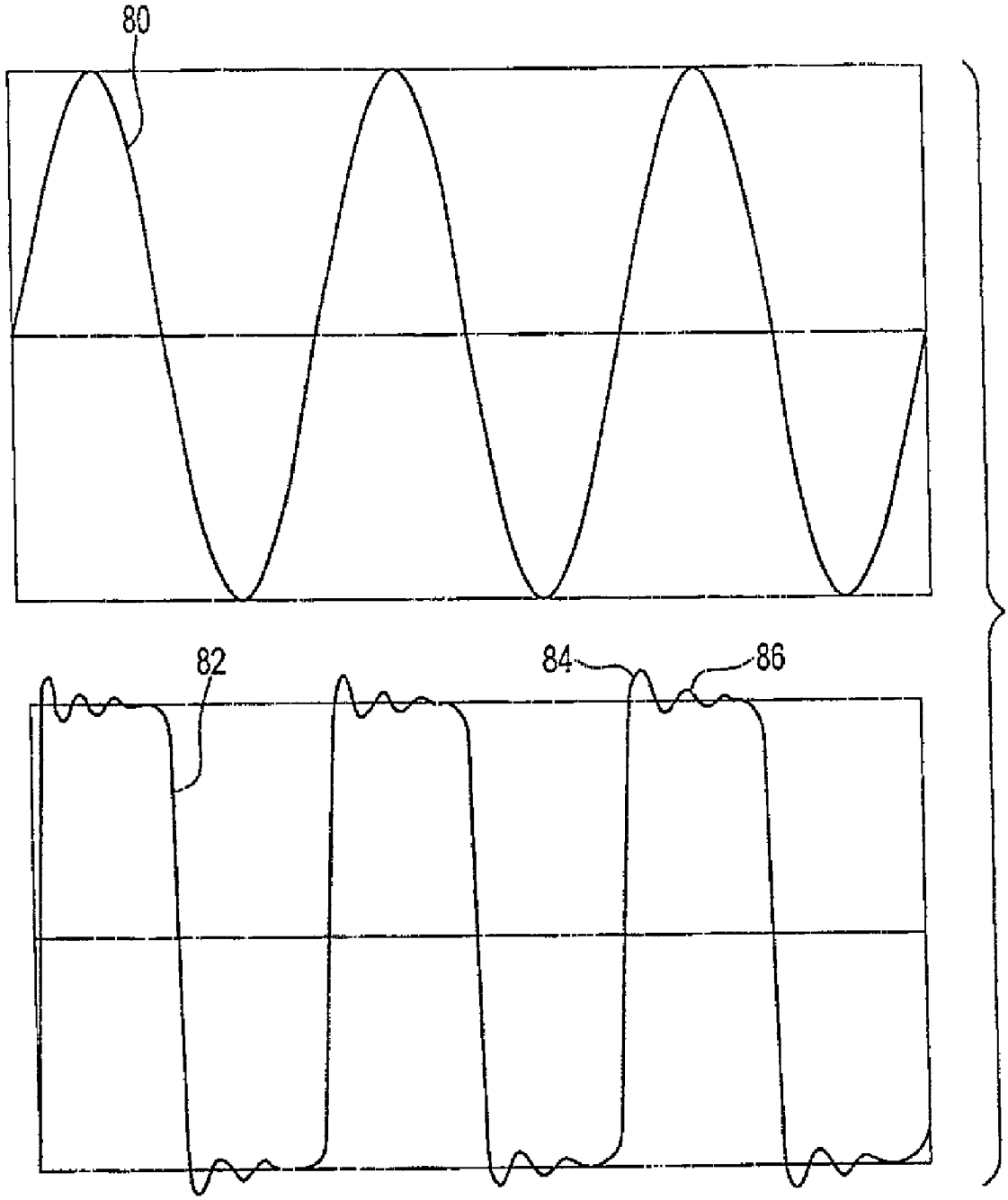
FIG. 4 is a comparison of a sinusoidal versus square waveform.

Sinusoidal waveforms are used for both linear and rotational impulses. A typical, sine wave 80 is shown in the top half of FIG. 4. The smooth nature of the curve is noted, in contrast to the abrupt, and imperfect square wave 82 below. The smooth sinusoidal waveform is judged to be superior for medical applications. The accepted industry technique for generating analog waveforms, and sinusoidal waveforms 80 in particular, is known as Pulse Width Modulation (PWM). Creation of analog waveforms using PWM and low pass filters is well known and well documented. Many companies manufacture and sell controllers or microprocessors that incorporate waveform tables and supply cookbook descriptions of analog waveform generation. Practical low pass filter circuits and their characteristics are included in the documentation. In brief, a high frequency digital output has its duty cycle modified to reflect an analog data value, like a point on a sine wave. This PWM pulse then travels through a low pass filter. The resultant signal carries the desired analog waveform, without use of a digital to analog converter (DAC). The impulse frequencies sought in the current invention are low, and a simple one-stage low pass filter, comprised of a resistor and capacitor, is sufficient to obtain a sine wave 80.

Complex waveforms may be derived from multiple frequencies and these are limited in practice only by the performance characteristics of the voice coil actuators. Precision audio voice coils 52 and 58 will typically operate in the range of 20 Hz to 40 KHz, as designed for stereo equipment and any complex waveform in that range may be produced and implemented in the ICID. The amplitude of the waveform is also selected by the practitioner and represents the impulse energy to be delivered during treatment. Maximum amplitude 96 and high end frequency are set for safety purposes. At present, the Latter is set at 200 Hz.

Figure 5:
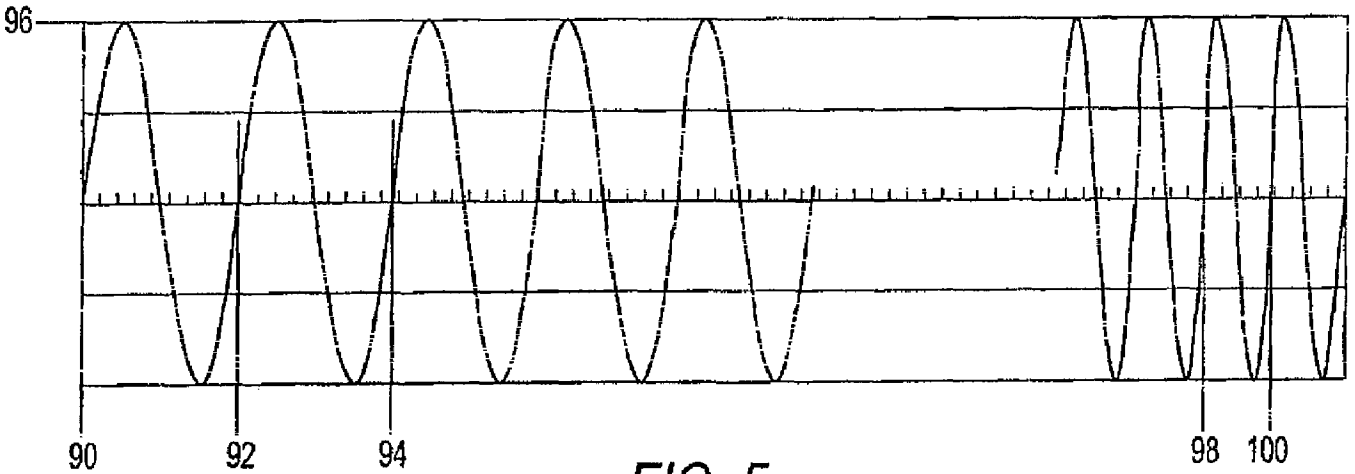
FIG. 5 is a sinusoidal waveform with linearly increasing frequency.
Figure 6:
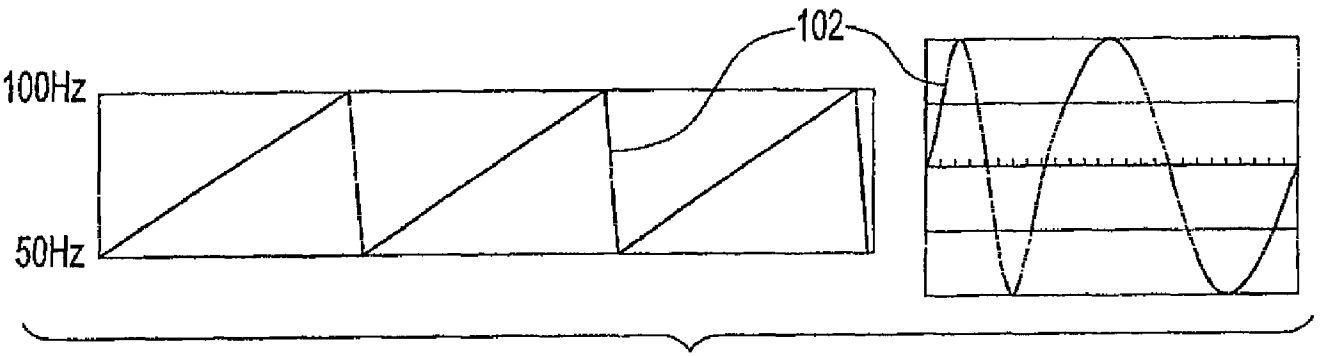
FIG. 6 is a linear frequency ramp and the waveform at the transition point.

The sinusoidal waveform selected for the current invention increases linearly in frequency as a function of time, as shown in FIGS. 5 and 6. Because of its audio characteristic, this waveform is called a chirp. In the preferred embodiment of the invention, the chirp starts with one cycle at 50 Hz 90, followed by cycles at 51 Hz 92, 52 Hz 93, and so on up to 99 Hz 98 and 100 Hz 100. At that time, the frequency resets to 50 Hz and the process starts again. The result is a linear frequency ramp as a function of time, as shown in FIG. 6. With an average frequency of 75 Hz, reset will occur every 0.67 sec. The number of pulses delivered depends on the pulse duration set by the practitioner. This is calculated and known before starting treatment. The frequency ramp in FIG. 6 shows a large discontinuity 102, but this does not appear on the actual impulse waveform applied to the patient. The breakout, diagram on the right illustrates that the discontinuity 102 is just a small change in the slope of the sine wave near the zero crossing, at the transition from 100 Hz to 50 Hz.

To recap, the use of a controller and PWM approach allows the creation of any complex waveform less than the 40 KHz range of the voice coil actuator. The selected waveform for the preferred embodiment of the invention is a linear frequency ramp or chirp, which cycles through 50 Hz to 100 Hz as shown in FIGS. 5 and 6. Square waves 82 will not be implemented in the current invention. A smooth sinusoidal waveform, like one with gradually increasing frequency, is viewed as an ideal impulse waveform for medical treatments.

Rotational impulses are also produced by a geared stepper motor. Typically the angle of rotation will be small, but this is not limited by the stepper motor, but rather by limit switches incorporated into the rotational gear system. The stylus end in contact with the patient has a non-smooth surface, in order to apply the rotational force. The irregular stylus end will have a bar pattern, or cross hairs, or multiple small protrusions. The irregular surface will have smooth edges, as necessary for patient comfort.

Alignment Angle and Data Validation

Figure 7:
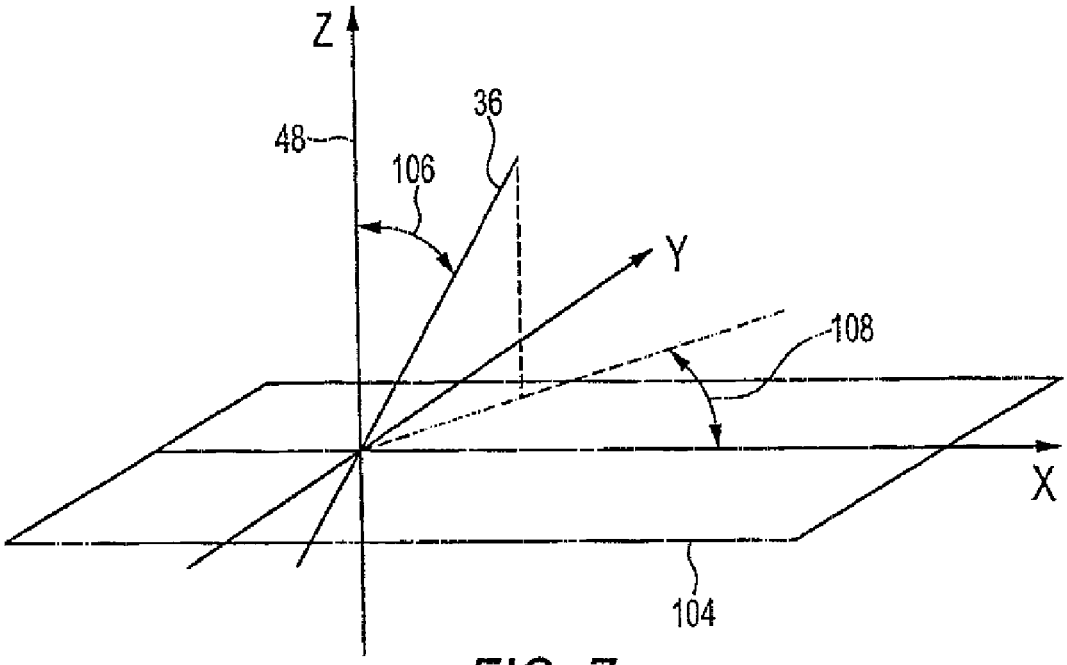
FIG. 7 is a diagram of angular or directional alignment in three dimensions.

A means to measure direction in 3D is shown in FIG. 7. The linear axis 36 of the stylus is represented relative to the vertical direction 48, which corresponds to the Z axis on a conventional 3D Cartesian co-ordinate system. At right angles to the vertical 48, the conventional Cartesian X and Y axes are shown lying in the horizontal plane 104. The direction of the patient bed 44, and zero position and direction of all spinal and upper cervical impulse treatment device components, are known relative to the selected X, Y, Z co-ordinate system. The angular direction of the linear axis 36 is therefore uniquely defined in 3D by the angle from the vertical, alpha 106, and a rotational angle from the X axis, beta 108, in the horizontal plane 104.

A desired treatment angle is determined by a practitioner on the basis of morphological data such as x-rays, physical examination, other inputs, and considerable clinical experience. Practitioners will record and track the efficacy of selected treatment angles across many patients and many situations. It is important to apply linear impulses at a correct treatment angle to obtain consistent results.

Figure 8:
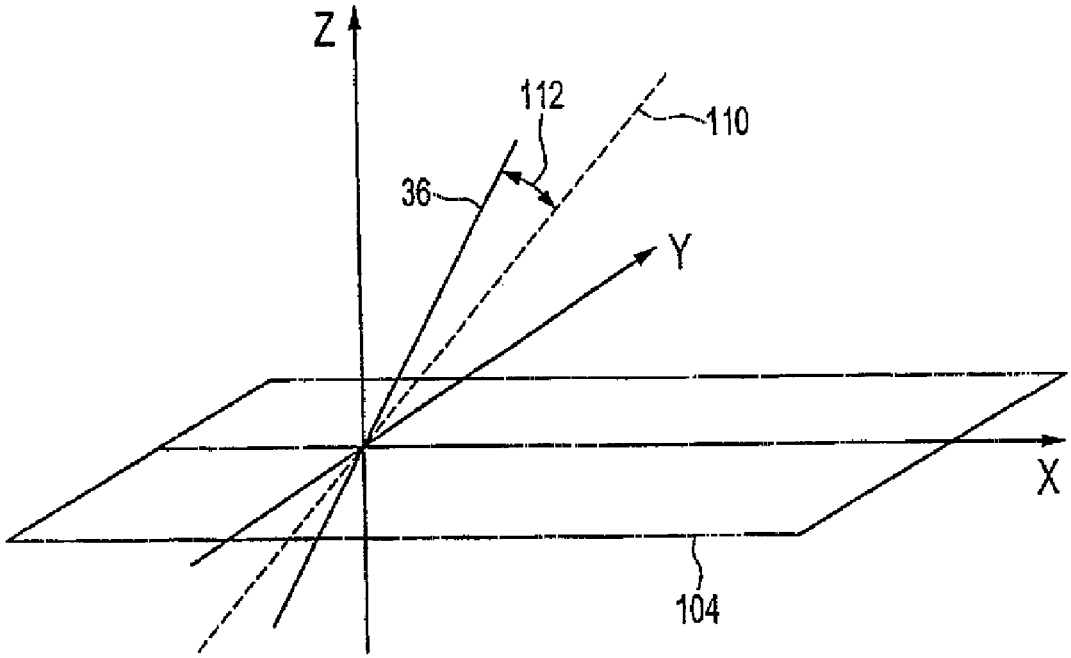
FIG. 8 is a comparison of actual alignment and preset treatment direction.

The current invention includes "data validation" to improve reliability. The actual angle 36 of the linear axis of the collapsible stylus 30 is measured in near real-time, at microsecond intervals, by any common angular measurement device. For example, accelerometers measure angular direction relative to vertical. As shown in FIG. 8, the actual angle 36 of the linear axis of the stylus is compared to the preset treatment angle 110, as defined by the practitioner. The measured linear axis angle 36 and the preset treatment angle 110 must be very close to one another before the device will start-delivering impulses. A maximum angular difference 112 is set by the device manufacturer and higher accuracy options are available to the practitioner. Locking mechanisms are engaged when the correct angular direction is achieved. If the locks fail and angular alignment is lost, the device will stop operating immediately (within microseconds).

This approach removes human error entirely from active treatment. Care must still be taken in setup and automated setup improvement methods are described further below. The current invention overcomes shortcomings in previous devices by preventing operation when the angle of the stylus axis 36 is misaligned relative to the preset treatment, angle 110.

Data validation has many elements. Additional controls are imposed on the device. The time duration of impulses, or number of impulses to be delivered, is automatically controlled in the current invention. Operation does not depend oh a human depressing and releasing a trigger, an approach that lacks accuracy and repeatability. Data validation also pertains to selection of impulse energy or intensity. A maximum impulse energy or sine wave amplitude is built into the transducer and this can be reduced by the practitioner. Maximum rotational angle is predefined, This is a minimum set of controls for the current invention.

Additional elements of data validation may be incorporated into the spinal and upper cervical impulse treatment device, based on experience by practitioners. For example, experience may show that certain frequencies have the best results in certain situations. Extensions in data parameter input, and associated data validation, are within the expected embodiments of the device.

Controller and User Interface

The spinal and upper cervical impulse treatment device is comprised primarily of a touchscreen 26 input panel and electronics motherboard 70. A controller will typically include a microprocessor and various input and output interfaces. As an alternative to the touchscreen 26, the user input panel may be implemented as any convenient combination of display and input components, such as a regular LCD display and keypad, or any other display and input mechanisms, which provide a friendly user interface (UI). Distinctive characteristics of the controller and input means of the spinal and upper cervical impulse treatment device include mounting on or near the device head, as shown in FIG. 2, as well as the friendly UI. By placing the controller 22 in the proximity of the transducer 24, the current, invention ensures that the attention of the practitioner can be focused on the region of the device. This design is preferred to separation of the impulse transducer from its controller, with some displacement between these two components of the system, a situation where a practitioner's attention is split across different regions of the system, and operational errors may occur.

Figure 1A:
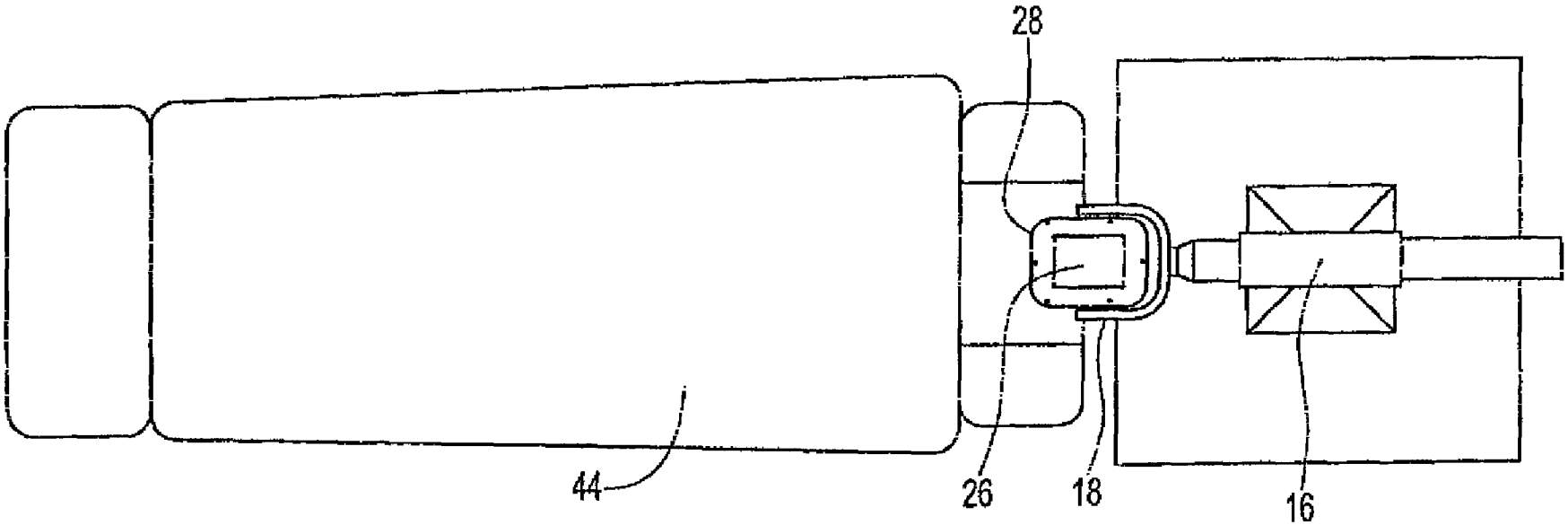
FIG. 1A is a top view of the apparatus in FIG. 1.

A user friendly interface via a touchscreen 26 is shown at the top of the device head 28 in FIG. 1A. The user interface is menu driven. There is a logical sequence to the functions displayed to the practitioner, to enable walk-through of the spinal and upper cervical impulse treatment device operational setup with relative ease. Default parameter settings are allowed as appropriate within treatment protocols. Final treatment parameter settings are to be displayed. Changes may be applied to the setting. There is no need to follow a sequence to adjust settings. Other means of device setup, such as automated data parameter input, are discussed next.

Automated Data Input

Automated data input is an optional but integral part of the spinal and upper cervical impulse treatment, device. A graphics tablet 42 is used to capture information from x-rays and overlaid, diagrams or other diagrams. The input is digitized, allowing the data to be manipulated by computer algorithms. An experienced medical practitioner has defined the calculations needed to produce the correct preset treatment angle 110. This is matched by the actual angle 36 of the linear axis of the impulse stylus in three dimensions. Other treatment parameters, such as linear and rotational impulse parameters, defining frequency and energy, are then added to fully define the spinal and upper cervical impulse treatment for a particular patient.

All treatment data parameters are organized so that they may be interpreted by the spinal and upper cervical impulse treatment device 22, Data parameters are transferred from a remote computer to the spinal and upper cervical impulse treatment device by any standard communications link 38, such as a serial link, or universal serial bus (USB) port, or wireless data link and the means of communications are not limited.

There are several advantages to automated data input First, it is more convenient to digitize data from a graphics tablet 42, than to manually calculate and input numbers from a diagram. Once data is in digital form, it can be manipulated by algorithms. Data may be archived on a computer 40, representing many patients and treatment situations. Such historic data and data patterns can be applied to new situations to improve the efficacy of treatment protocols. Once treatment parameters have been defined, these may be automatically compared to other data, as well as being reviewed by an experienced practitioner. Thereafter, treatment parameters are applied by the spinal and upper cervical impulse treatment device, in an accurate and consistent manner, providing overall confidence in treatment protocols.

Patient Therapy Flow Chart

Figure 9:
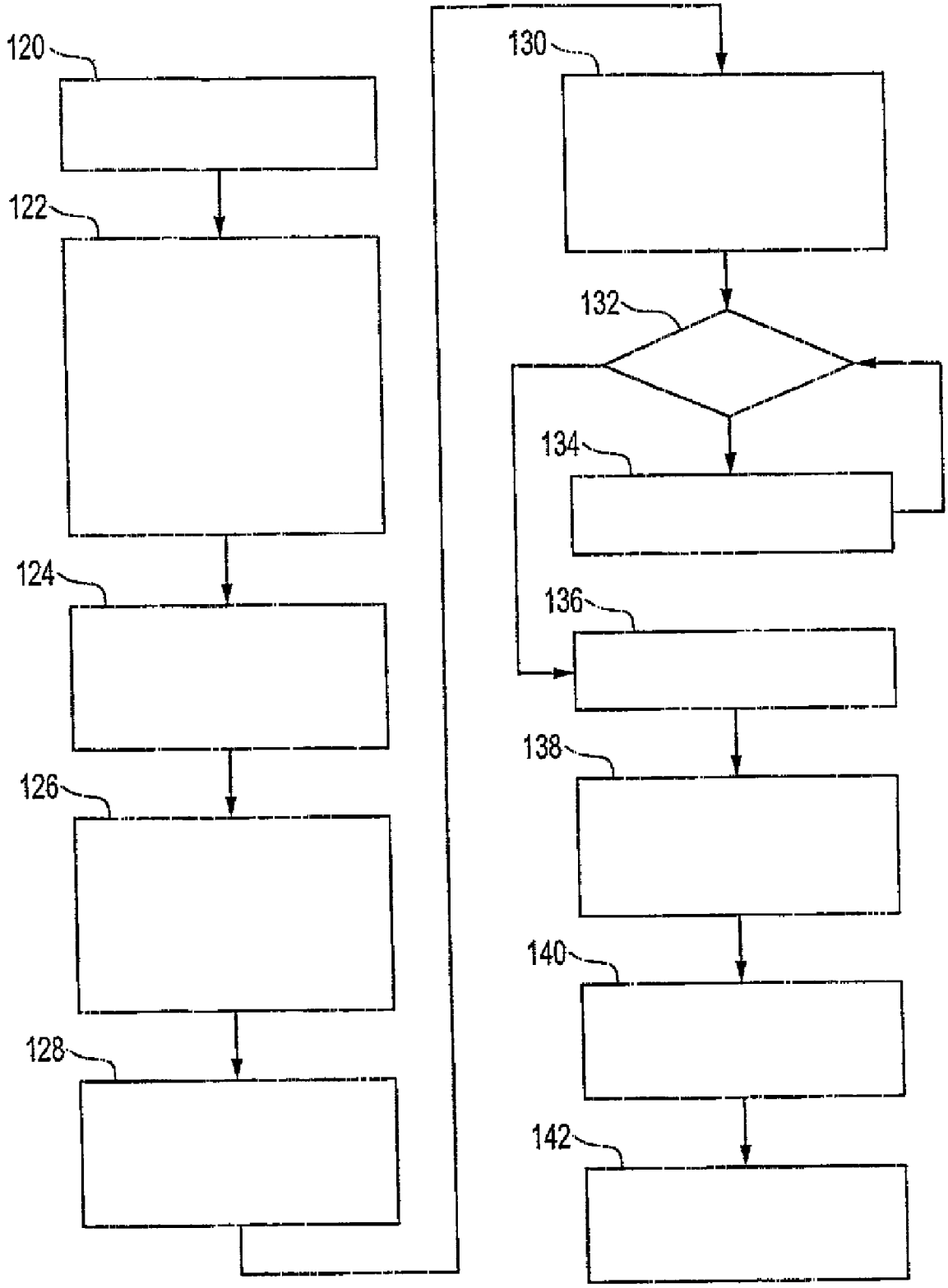
FIG. 9 is a flow chart of the treatment process employing the spinal and upper cervical impulse treatment device.

The therapeutic application of the spinal and upper cervical impulse treatment device is described as a flow chart of operations in FIG. 9. A patient examination and consultation takes place at step 120. At step 122 pre-treatment x-rays are taken as well as static measurements of pelvic/shoulder unlevelling and leg length discrepancy, using calipers on the body. Data points of interest are marked on the graphics tablet, such as cervical tilt, head tilt and atlas position, relative to the skull and cervical spine. At step 124, digitised data points are transferred from the graphics tablet to a computer. X-ray analysis is conducted in three dimensions using custom spinal and upper cervical impulse treatment software. At step 126, data parameters for device operation are derived from the spinal and upper cervical impulse treatment software and data archives, including: (a)—linear impulse frequency and duration, (b)—linear impulse angle, (c)—linear impulse force, and (d)—rotational angle. Data parameters are transferred to the spinal and upper cervical impulse treatment software, manually via touch-screen, or automatically via a serial data communications link at step 128. At step 130, impulse parameters are validated in the spinal, and upper cervical impulse treatment software, including maximum impulse force, frequency and duration. Settings are displayed on the touchscreen 26. At step 132, whether the measured linear impulse angular direction is in close agreement with the preset treatment angular direction is tested. The allowed difference is preset. If correct alignment is not achieved, then the system goes to step 134. If alignment is acceptable, then the system goes to step 136. At step 134, the angle of the stylus linear axis is adjusted to try to achieve correct alignment. The system then returns to step 132. At step 136, once angular alignment is achieved, the angle of the linear axis of the stylus is fixed or locked and the location of the stylus end is locked. The spinal and upper cervical impulse treatment transducer is then allowed to start operation. If angular alignment is lost, operation will cease. The calculations in steps 232 and 134 are ongoing during treatment. At step 138, post spinal and upper cervical impulse treatment includes measurement of the impact of treatment on pelvic/shoulder unlevelling and leg length discrepancy, using body calipers. At step 140, following review and recommendations, the patient's next appointment is scheduled as needed. At step 142, post-treatment, x-ray analysis is conducted after 5 weeks, to determine progress and the efficacy of the treatment.

Accordingly, while this invention has been described with reference to illustrative embodiments, this description is not intended to be construed in a limiting sense. Various modifications of the illustrative embodiments, as well, as other embodiments of the invention, will be apparent to persons skilled in the art upon reference to this description. For example, any connector that provides the functionality of the horizontal arm and stand coupling may be used, as can any actuator or rotator for driving the stylus in the specified direction. It is therefore contemplated that the appended claims will cover any such modifications or embodiments as fall within the true scope of the invention.

We claim:

1. A medical device for use with a stand, the device comprising a connector, an impulse treatment head, a stylus, and a display, wherein:

(i) the connector pivotally engages the impulse treatment head and is operable to rotate about a longitudinal axis of the connector and to move the impulse treatment head longitudinally, thereby providing the impulse treatment head with multiple degrees of freedom;

(ii) the impulse treatment head comprises an actuator for driving the stylus in a linear direction;

(iv) the stylus:

a) is slidably located in the impulse treatment head;

b) extends from the impulse treatment head so as to contact a patient;

c) is coupled to the actuator and d) is collapsible upon meeting resistance of a predetermined force value; and (v) the display is for inputting stylus alignment information and for displaying alignment of the stylus with the patient.

2. The medical device of claim 1 wherein the connector is further configured to tilt from a horizontal plane.

3. The medical device of claim 2, wherein the actuator is a voice coil actuator.

4. The medical device of claim 3 wherein the voice coil actuator is operative to transmit sinusoidal impulse waveforms along a linear axis of the stylus.

5. The medical device of claim 4 further comprising a rotator for driving the stylus in a rotational direction, wherein the rotator is in mechanical communication with the stylus.

6. The medical device of claim 5 wherein the collapsible stylus comprises a safety coupling.

7. The medical device of claim 6, wherein the display is a touchscreen mounted on a top of the impulse treatment head.

8. A medical device for use with a stand, the device comprising an arm, an impulse treatment head, a stylus, and a display, wherein:

(i) the arm is configured for engagement with a stand, is rotatable about its own axis and is moveable horizontally, and comprises a yoke, wherein the yoke pivotally engages the impulse treatment head, thereby permitting multiple degrees of freedom between the impulse treatment head and a stand;

(ii) the impulse treatment head comprises a voice coil actuator for driving the stylus in a linear direction and a rotator for driving the stylus in a rotational direction;

(iv) the stylus:

a) is slidably located in the impulse treatment head;

b) extends from the impulse treatment head so as to contact a patient; and c) is in mechanical communication with the actuator and rotator; and (v) the display is for inputting stylus alignment information and for displaying alignment of the stylus with the patient.

9. The medical device of claim 8 wherein the connector is further configured to tilt from a horizontal plane.

10. The medical device of claim 9 wherein the voice coil actuator is operative to transmit sinusoidal impulse waveforms along a linear axis of the stylus.

11. The medical device of claim 10, wherein the rotator further comprises a voice coil actuator operative to transmit rotational sinusoidal impulse waveforms to the stylus.

12. The medical device of claim 11, including a microprocessor programmed to recognize correct alignment, and to permit operation to commence only when proper alignment is achieved.

13. The medical device of claim 12 further comprising an external computer coupled to the medical device, the external computer for entering morphological data of aspects of the patient and transferring these data points from the external computer to the medical device.

14. A medical device comprising a connector, an impulse treatment head, a display and a stylus, wherein the connector is for connecting the device to a stand, such that in use, the impulse treatment head has multiple degrees of freedom relative to the stand and is configured to produce impulses that drive the stylus in sinusoidal waves and wherein the display is for inputting stylus alignment information and for displaying alignment of the stylus with a patient.

15. A method of treating a patient in need thereof comprising:

(i) collecting morphological data on the patient;

(ii) inputting the data into a medical device;

(iii) delivering acoustic, sinusoidal waves ranging from about 50 Hertz to about 200 Hertz to the patient using the medical device.

16. The method of claim 15 wherein the morphological data are X-ray results.

17. The method of claim 16 wherein the morphological data are caliper measurements.

18. The method of claim 17 further comprising: (iv) collecting X-ray results following the treatment.

* * * * *